United States Patent [19]

Tucek

[11] 4,140,200

[45] Feb. 20, 1979

[54] CONTROL DEVICE AND ARM SUPPORT

[75] Inventor: Frank J. Tucek, Wausau, Wis.

[73] Assignee: J. I. Case Company, Racine, Wis.

[21] Appl. No.: 801,149

[22] Filed: May 27, 1977

[51] Int. Cl.[2] ..... G05G 9/04

[52] U.S. Cl. ..... 180/77 H; 74/471 XY; 180/77 HT

[58] Field of Search ..... 180/77 R, 77 S, 77 H, 180/77 HT; 74/471 R, 471 XY, 491

[56] References Cited

U.S. PATENT DOCUMENTS

| | | | |
|---|---|---|---|
| 1,874,522 | 5/1931 | Henrichsen | 74/491 X |
| 2,618,447 | 11/1952 | Lecarme | 74/471X |
| 2,638,290 | 5/1953 | Lecarme | 74/491 X |
| 2,659,275 | 11/1953 | Ericsson | 74/471 R X |
| 3,191,994 | 6/1965 | Boyce | 297/411 |
| 3,893,346 | 7/1975 | Paul | 74/471 R |
| 3,897,805 | 8/1975 | Casey | 74/471 XY X |

*Primary Examiner*—Joseph F. Peters, Jr.
*Assistant Examiner*—Michael Mar
*Attorney, Agent, or Firm*—Dressler, Goldsmith, Clement, Gordon & Shore, Ltd.

[57] ABSTRACT

A control system for operating a plurality of controlled devices forming part of a vehicle that has an operator's seat which includes an arm rest which is pivotally supported on the frame and is movable in the fore-and-aft direction to operate at least one of the controlled devices. The arm rest pivotally supports a control lever which is movable about a fixed axis on the arm rest for actuating a second controlled device and the control lever is positioned so that the forearm of the operator can remain resting on the arm rest during operation of all of the controlled devices. The system is also designed so that the upper portion of the arm rest which has the control lever supported thereon can be pivoted with respect to a lower portion without effecting operation of any of the controlled devices.

8 Claims, 7 Drawing Figures

40
80
44
46
48
19
18
42
52
56
54
50
58
16
10
22
20
66
64
61
62
63
68
72
30
4
4

16
20
22
10
24
26
30

CONTROL DEVICE AND ARM SUPPORT

BACKGROUND OF THE INVENTION

The present invention relates generally to vehicles and more particularly to control systems for controlling various functions of such vehicles.

Normal operation of heavy duty equipment, such as cranes, excavators and loaders, the operator is constantly required to control various work functions which are usually activated through the use of hand levers. For example, in an excavating operation the operator must constantly actuate the swing and crowd controls to perform the digging operation and manipulate other controls for controlling the vehicle. Many heavy duty industrial vehicles incorporate a hand control which is commonly referred to as a "joy stick" control wherein a single control lever is universally movable and is capable of controlling at least four different functions on a machine. One of the problems that have been encountered with previously known control devices is operator fatigue, since they must constantly manipulate control devices all day long.

SUMMARY OF THE INVENTION

The present invention provides a control system for controlling various functions necessary for operation of the vehicle which substantially reduces operator fatigue, particularly the arms of the operator.

According to the present invention, the forearms of an operator can be supported at all times during operation of the machine. More specifically, the control system of the present invention is incorporated into a vehicle that includes a frame supporting an operator's seat having an arm rest on one side thereof and a plurality of controlled devices. The arm rest is movable in a fore-and-aft direction and has a linkage system connected thereto for moving a first control device to perform one of the operating functions. The arm rest also supports a control lever for rotational movement about a fixed axis for controlling at least a second one of the controlled devices. The linkage systems associated with the arm rest and control lever are designed so that movement of either, individually, will not effect the position of the remaining controlled devices.

In addition, the arm rest is designed so that the upper portion thereof can be pivoted for gaining access to the seat without effecting the position of any of the controlled devices. If desired, an additional control in the form of an electrical switch can be incorporated into the handle portion of the control lever to provide a further controlled function.

In its specific embodiment, the vehicle incorporates two arm rests on opposite sides of the vehicle each of which is connected to at least one controlled device while each arm rest has a control lever associated therewith which is again connected to at least one controlled device.

DETAILED DESCRIPTION

Figure 1:
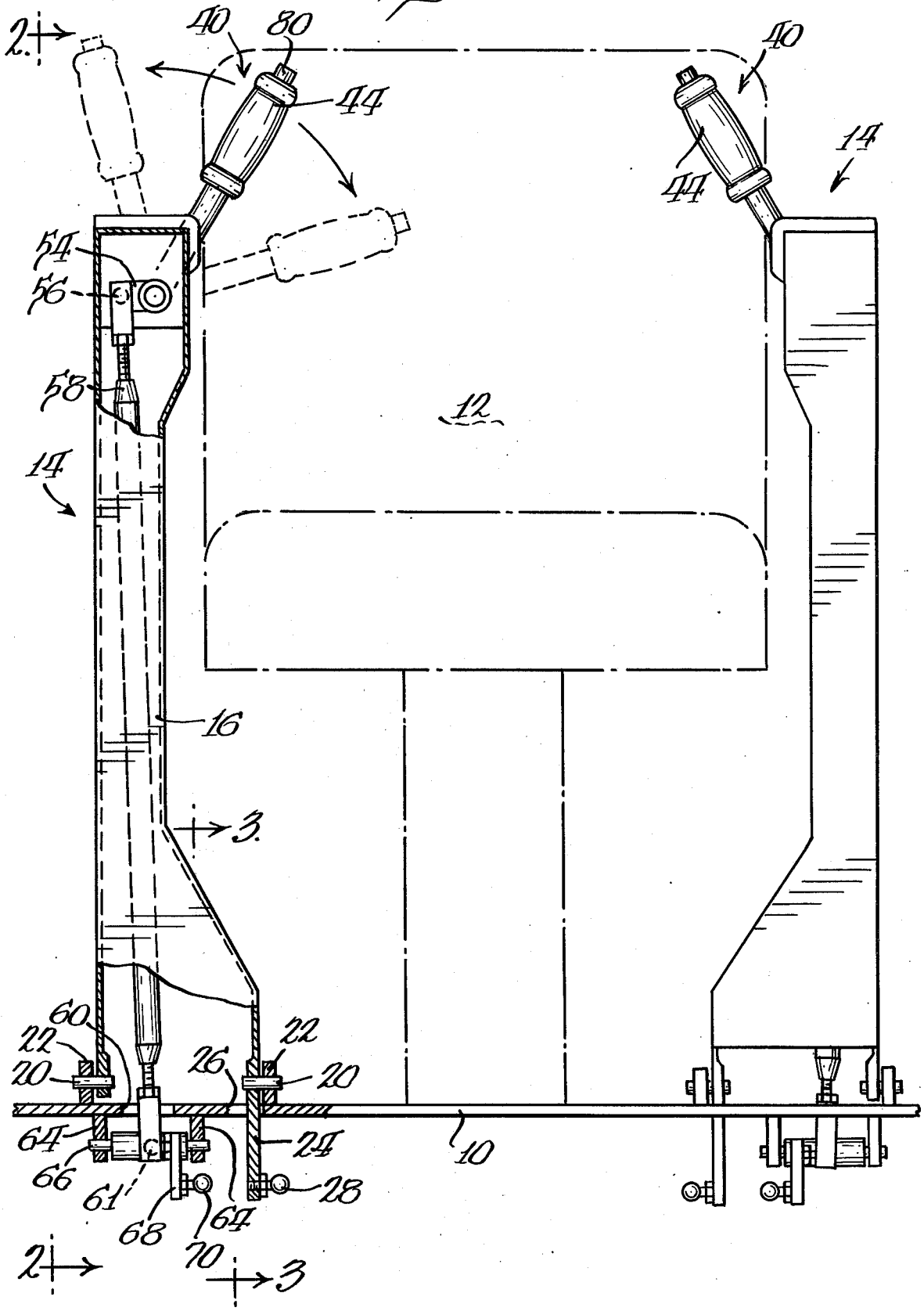
FIG. 1 shows a rear view of an operator's station of a vehicle with the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings shows an operator's station of a vehicle that includes a frame 10 which supports a seat 12 that has arm rests 14 on opposite sides thereof.

According to the present invention, both arm rests 14 form parts of a control system for controlling a plurality of functions which are operated by valves, switches or other devices.

Figures 2, 3:
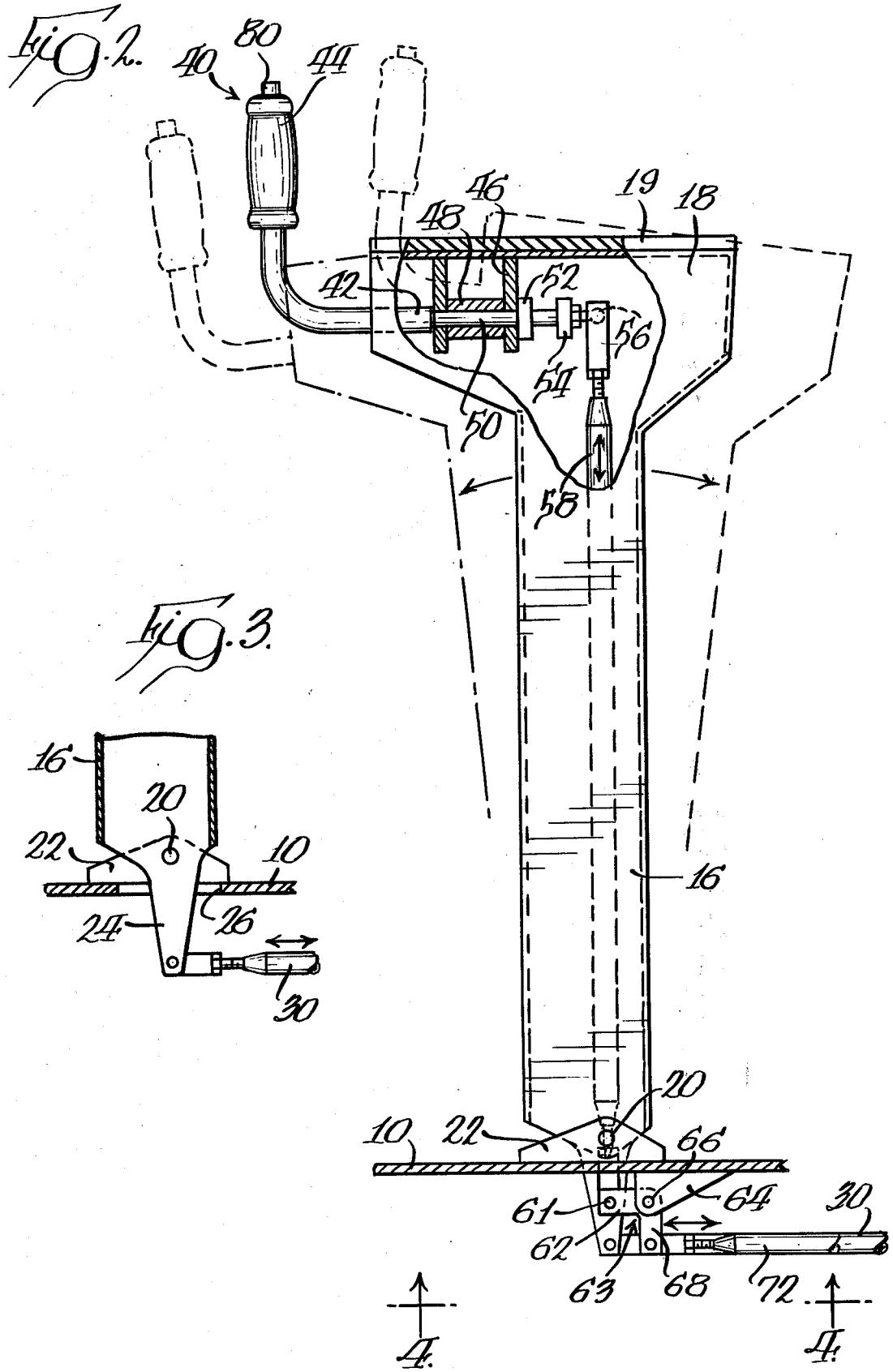
FIG. 2 is a side view as viewed along line 2—2 of FIG. 1.
FIG. 3 is a fragmentary sectional view as viewed along line 3—3 of FIG. 1.

Each arm rest 14 (FIGS. 1 and 2) consists of a hollow generally rectangular lower portion 16 which extends generally vertically and a hollow generally rectangular upper generally horizontal portion 18. Upper horizontal portion 18 may have some cushioning material 19 on the upper surface thereof upon which the forearm of an operator may be supported, as will be described later. Generally, upright vertical portion 16 is pivotally supported at its lower ends by pivot pins 20 which are supported on brackets 22 that extend upwardly from frame 10 on opposite sides of the vertical portion 16 of arm rest 14. Thus, arm rest 14 can be moved in a generally fore-and-aft direction as illustrated in FIG. 2.

The lower end of upright portion 16 has a member 24 integral therewith which extends through an opening 26 in the frame or floor 10 of the operator's station of the vehicle. The lower end of member 24 has a ball joint 28 receiving one end of an adjustable link 30, the opposite end of which is connected to a controlled device (not shown), such as a spool type hydraulic control valve. Thus, movement of the arm rest 14 in a fore-and-aft direction, illustrated by the three positions in FIG. 2, may be utilized for actuating a control valve in opposite directions from a neutral condition.

According to another aspect of the invention, the control system also includes a second control member which forms part of arm rest 14. The second control member includes a control lever 40 consisting of a shaft 42 which has a handle 44 at one end thereof. Shaft 42 is rotatably supported about a generally horizontal axis defined on the upper portion 18 of arm rest 14 by brackets 46 and a sleeve 48. Shaft 42 has a reduced portion 50 received through an opening in sleeve 48 and a collar 52 releasably retained on reduced portion 50 of shaft 42 so that the shaft 42 and, therefore, control lever 40 cannot be moved in a fore-and-aft direction.

Figure 4:
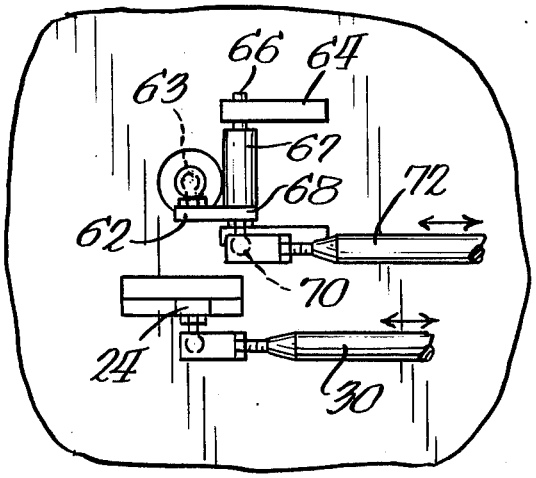
FIG. 4 is a fragmentary view as viewed along line 4—4 of FIG. 2.

The rear end of reduced portion 50 of control lever 40 has an arm 54 extending radially therefrom with the outer end of the arm or member 56 having a ball joint 56. One end of an adjustable link 58 is received on ball joint 56 and extends through the hollow vertical portion 16 of arm rest 14 with the lower end thereof extending through an opening 60 defined in the floor or frame 10. The lower free end of adjustable line 58 is connected by a ball joint connection 61 to a first arm 62 of a bell crank 63 that is pivotally supported on brackets 64 that are secured to frame 10 with a pin 66 and a sleeve 67 (FIG. 4) defining the pivotal connection. A second arm 68 of bell crank 63 again has a ball joint 70 which supports one end of a link 72, the opposite end of which is again connected to a controlled device (not shown).

With the control system so far described, a first controlled device can be operated by rotation of the control lever 40 about its generally horizontal axis to the various positioned illustrated in FIG. 1 and this rotational movement is transmitted to a controlled device through linkage means that includes arm or member 54, link 58, bell crank 63, and link 72. For example, assuming that the controlled device is a three-position valve that has a center biased neutral position and two detented operative positions, the neutral position could be the solid-line position illustrated in FIG. 1, while the respective operative positions of the control valve could be the two dotted-line positions illustrated in FIG. 1.

Likewise, movement of the entire arm rest 14 in the fore-and-aft direction as illustrated in FIG. 2 would operate a second controlled device. In addition, the second arm rest 14 and second control lever on the opposite side of seat 12 could likewise be utilized for operating two additional controlled devices. During the entire time the forearms of the operator can be supported upon the upper horizontal portions 18 of the respective arm rests 14.

An additional function can be performed with each hand of the operator by positioning an electrical switch 80 in the upper end of control handle 44 and connecting this electrical switch to an electrically actuated controlled device such as a solenoid operated valve. Thus, the operator can readily control six different functions with a minimum amount of manipulation of his arms and the arms are supported at all times to reduce operator fatigue.

In addition, movement or operation of one controlled device does not in any way effect the position of any of the other devices. This function results from the particular location of the respective pivot axes and the use of ball joint connections. For example, the pivot pin 66 is located in close proximity to pivot pin 20 and the axes of both of these pins extend generally transversely of the vehicle so that pivotal movement of arm rest 14 about pins 20 will not result in any significant movement of the bell crank or link 72 while the control lever 40 is moved in the fore-and-aft direction with the arm rest 14. Pins 20 and 66 could readily be located on a common axis so that there would be no movement of link 72 when link 30 is moved by arm rest 14. Likewise, rotational movement of control lever 40 will not result in any movement of control link 30.

As indicated above, if the controlled devices are three-position control valves which have detented operative positions and are biased to a central neutral position, there is no necessity for having any additional position defining means for control lever 40 and arm rest 14. However, if desired, the control lever 40 as well as the arm rest 14 could have detented operative positions defining the respective desired positions for the controlled device. In addition, if two controlled devices were to be actuated simultaneously and the movement thereof could be correlated, additional controlled devices could be actuated by the arm rest as well as the control lever. For example, if two control valves were to be simultaneously operated and each control valve required a movement of an equal amount in opposite directions, the bell crank could have a further arm extending in the opposite direction from arm 68 and have a further control link secured thereto for connection to a further controlled device. Likewise, if two controlled devices required different amounts of movement and needed to be simultaneously actuated, a second control link could be connected to member 24 or bell crank 63 for this purpose.

Figure 5:
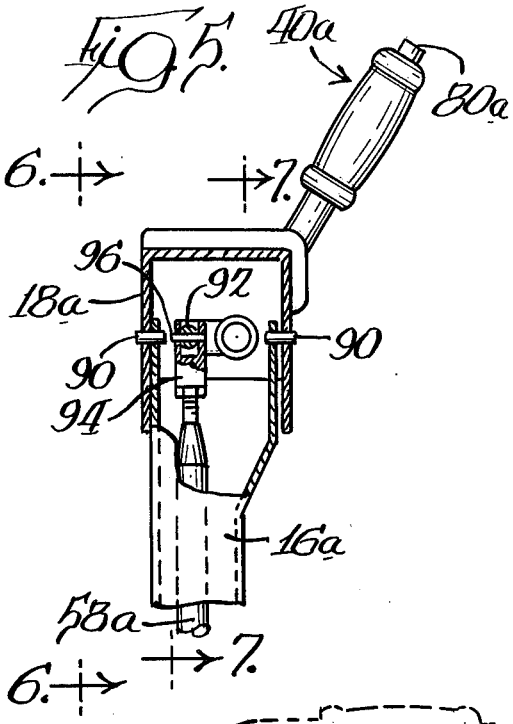
FIG. 5 is a fragmentary view of the upper end of the control system, showing a slightly modified form of the invention.
Figure 6:
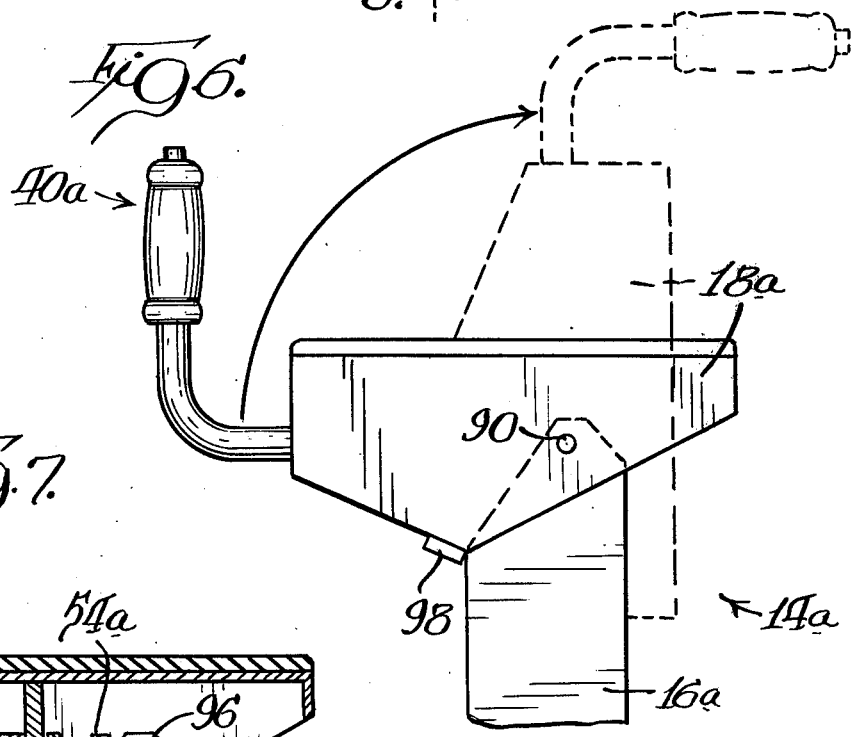
FIG. 6 is a side elevation view as viewed along line 6—6 of FIG. 5.
Figure 7:
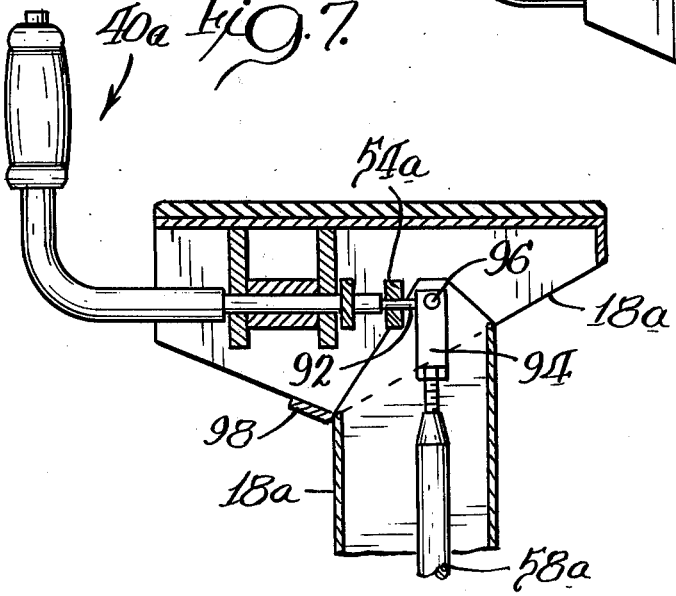
FIG. 7 is a sectional view as viewed along line 7—7 of FIG. 5.

A slightly modified form of the invention is illustrated in FIGS. 5, 6 and 7 and since most of the parts are substantially identical the same reference numerals have been utilized with the addition of the suffix (a). In this embodiment, the upper horizontal portion of the arm rest is capable of being pivoted with respect to the lower portion thereof without any movement of the controlled devices associated with the arm rest.

In this embodiment, the generally vertical portion **16*a* of arm rest 14*a* is again pivoted about pivot pin 20 (FIG. 2) and generally horizontal portion 18*a* is pivotally connected to the upper end of vertical portion 16*a* through a pair of pivot pins 90. In this embodiment, ball joint connection 56 is replaced with a pivotal connection that will now be described. The free end of arm 54*a* has a pin 92 extending therefrom and pin 92 is received between the arms of a bifurcated portion 94 on the upper end of link 58*a*. A pin 96 extends through openings in the arms of the bifurcated portion 94 so that pin 92 is pivotally connected to the upper end of adjustable link 58*a*. Pins 92 and 94 and arm or member 54*a* are designed so that pin 96 is located on a common axis with pins 90 when control lever 40*a* is in a position corresponding to the neutral position for the controlled device associated therewith. Therefore, upper horizontal portion 18*a* and control lever 40*a* may be pivoted from the solid-line position to the dotted-line position shown in FIG. 6 without movement of any of the controlled devices since the pins 90 and 96** are located on a common axis. This arrangement may be desirable when the operator's compartment is small and congested so that the operator can readily gain access to the seat.

It is preferable that the lower operative position be a fixed position and for this purpose, arm rest or horizontal portion **18*a* has a bracket or stop 98 which engages vertical portion 18*a*** to define an operative position for the horizontal portion with respect to the vertical portion of the arm rest. Of course, if desired, this position could be defined by a detent or a spring biased latch mechanism (not shown).

As can be appreciated from the above description, the present invention provides an extremely unique control system for a vehicle which has many controlled devices that perform numerous different functions. The various parts are arranged in such a manner that the operator can support the forearms on the arm rest at all times if desired.

What is claimed is:

1. A control system for a vehicle including a frame supporting an operator's seat having an arm rest and a plurality of controlled devices, a control lever, mounting means supporting said control lever for rotational movement about a generally fore-and-aft horizontal axis on said arm rest, said control lever having a handle adjacent a free end of said arm rest, said control lever and handle being positioned so that an operator seated on said seat can grip said handle and pivot said control lever about said axis while having a forearm supported on said arm rest, first linkage means connecting said control lever to at least one of said controlled devices and operated in response to pivotal movement of said control lever about said horizontal axis, support means on said frame for pivotally supporting said arm rest on said frame about a second axis extending generally perpendicular to said horizontal axis, said first linkage means having means accommodating pivotal movement of said arm rest about said second axis without movement of said at least one of said controlled devices, and second linkage means connecting said arm rest to another of said controlled devices for actuation thereof in response to pivotal movement of said arm rest about said second axis.

2. A control system as defined in claim 1, further including electrical switch means in said handle and connected to a controlled device which is electrically actuated.

3. A control system as defined in claim 1, in which said arm rest is located on one side of said seat, further including a substantially identical second arm rest and control lever on an opposite side of said operator's seat.

4. A control system for a vehicle including a frame supporting an operator's seat with a pair of arm rests respectively located on opposite sides, each of said arm rests including a generally vertical portion extending above said frame and a generally horizontal portion at the upper end of said vertical portion, said horizontal portion being adapted to support a forearm of an operator; mounting means for mounting said vertical portion on said frame for movement with respect thereto; first linkage means connected to said vertical portion for moving an actuating device in response to movement of said vertical portion with respect to said frame; a control lever pivoted about a fixed axis on said generally horizontal portion, second linkage means connecting said control lever to an actuating device; and a control handle on said control lever positioned so that an operator can grip said handle while resting a forearm on said horizontal portion.

5. A control system as defined in claim 4, in which each mounting means defines a generally horizontal pivot axis and in which said fixed axis extends perpendicular to said generally horizontal pivot axis, further including pivot means defining a further pivot axis between at least one vertical portion and horizontal portion.

6. A control system as defined in claim 5, further including switch means in each handle for actuating an electrical actuating device.

7. A control system for a vehicle including a frame supporting an operator's seat having an arm rest and a plurality of controlled devices, a control lever, mounting means supporting said control lever for rotational movement about a generally horizontal axis on said arm rest and extending generally fore-and-aft of said vehicle, said control lever having a handle adjacent a free end of said arm rest, said control lever and handle being positioned so that an operator seated on said seat can grip said handle and pivot said control lever about said axis while having a forearm supported on said arm rest, first linkage means connecting said control lever to at least one of said controlled devices and operated in response to pivotal movement of said control lever about said axis, support means on said frame for pivotally supporting said arm rest on said frame about a second axis extending generally transversely of said vehicle, said first linkage means having means accommodating pivotal movement of said arm rest about said second axis without movement of said at least one of said controlled devices, and second linkage means connecting said arm rest to another of said controlled devices for actuation thereof in response to pivotal movement of said arm rest about said second axis, said arm rest including generally vertical portion pivoted on said second axis and a generally horizontal portion pivoted on an upper end of said generally vertical portion about a third axis extending parallel to said second axis with said control lever pivoted on said generally horizontal portion and in which said first linkage means on said control lever has a pivotal connection aligned with said third axis so that said generally horizontal portion and said control lever can be pivoted about said third axis without changing the position of any of said controlled devices.

8. A control system for a vehicle including a frame supporting an operator's seat having a hollow arm rest and a plurality of controlled devices, a control lever, mounting means supporting said control lever for rotational movement about a generally horizontal axis on said arm rest, said control lever having a handle adjacent a free end of said arm rest, said control lever and handle being positioned so that an operator seated on said seat can grip said handle and pivot said control lever about said axis while having a forearm supported on said arm rest, first linkage means connecting said control lever to at least one of said controlled devices and operated in response to pivotal movement of said control lever about said axis, support means on said frame for pivotally supporting said arm rest on said frame about a second axis extending generally perpendicular to said horizontal axis, said first linkage means having means accommodating pivotal movement of said arm rest about said second axis without movement of said at least one of said controlled devices, and second linkage means connecting said arm rest to another of said controlled devices for actuation thereof in response to pivotal movement of said arm rest about said second axis, said first linkage means including a shaft rotated about said horizontal axis in said arm rest with a member extending radially therefrom, a link in said arm rest having a ball joint connection at one end with a free end of said member, and bell crank pivoted about an axis parallel to and adjacent to said second axis with a ball joint connection between one arm of said bell crank and an opposite end of said link and a second arm of said bell crank connected to said at least one of said controlled devices.

* * * * *